US006825866B2

(12) United States Patent
Majewicz et al.

(10) Patent No.: US 6,825,866 B2
(45) Date of Patent: Nov. 30, 2004

(54) LED ARRAY ARCHITECTURE FOR HIGH RESOLUTION PRINTBARS

(75) Inventors: Peter I. Majewicz, Emmett, ID (US); Mark A. Cellura, Webster, NY (US)

(73) Assignee: Xerox Corporation, Stamford, CT (US)

( * ) Notice: Subject to any disclaimer, the term of this patent is extended or adjusted under 35 U.S.C. 154(b) by 308 days.

(21) Appl. No.: 10/044,771

(22) Filed: Jan. 10, 2002

(65) Prior Publication Data

US 2003/0127006 A1 Jul. 10, 2003

(51) Int. Cl.[7] ..... B41J 2/45

(52) U.S. Cl. ..... 347/238; 347/257; 257/88; 438/106; 438/107

(58) Field of Search ..... 347/238, 237, 347/256, 257; 257/88; 438/107, 106; 313/500, 498

(56) References Cited

U.S. PATENT DOCUMENTS 5,691,760 A 11/1997 Hosier et al. ..... 347/238
5,801,404 A * 9/1998 Kahen et al. ..... 257/101
5,821,567 A 10/1998 Ogihara et al. ..... 257/88
2001/0007359 A1 7/2001 Ogihara et al. ..... 257/88

FOREIGN PATENT DOCUMENTS

EP 0 510 274 A1 10/1992
JP 62056163 A * 3/1987 ..... B41J/3/21
JP 06140671 A * 5/1994 ..... H01L/33/00

OTHER PUBLICATIONS

Machine translation of JP 06140671 to Matsushita from Japanese Patent Office website.*

* cited by examiner

*Primary Examiner*—Daniel J. Colilla
(74) *Attorney, Agent, or Firm*—Perman & Green, LLP

(57) ABSTRACT

A method and apparatus for forming a high resolution LED array. A plurality of LED chips are provided to form the LED array. Each LED chip has an electrode that is inward biased at each end of the chip by a predetermined amount. The size of each LED chip is removed by reducing, at each end of each chip, an amount of chip material substantially equal to the predetermined amount. The array is formed by placing each chip end to end with a gap between each chip, wherein the gap is suitably large for placement accuracies and a consistent pitch of 21.2 $\mu$m is maintained between each LED on each chip.

6 Claims, 6 Drawing Sheets

LED ARRAY ARCHITECTURE FOR HIGH RESOLUTION PRINTBARS

BACKGROUND OF THE INVENTION

1. Field of the Invention

The present invention relates to an LED printing device and, more particularly, to a high resolution LED array bar.

2. Brief Description of Related Developments

It is common to use light emitting diode (LED) bars in printing devices. LED bars provide reliable and controllable light sources. The bars generally comprise a plurality of light sources, i.e., pixels that can be activated and deactivated (pulsed) to emit short bursts of light at a high rate of speed. Each light burst is used to create a particular portion of a printed symbol or character. The more often a pixel is pulsed, the more often a symbol or character portion will be imaged, thus providing greater detail and higher resolution printing. Therefore, for the printing to be completed within a commercially reasonable time with high resolution, it is necessary to have a high rate of pulsing.

LED bars are manufactured in different segment, or chip, sizes. Segment size depends on the number of pixels within the segment. Two popular numbers of pixels per segment are 64 pixels and 128 pixels. At 424.26 spot per inch (SPI) these segments would be 3.832 and 7.663 mm respectively. The respective lengths are determined by dividing the number of pixels by the spot per inch requirement and converting the quotient to millimeters. For example:

$$64(\text{pixels}) \times \frac{1}{424.26\ (\text{spi})} = .1509\ \text{in} \times 25.4\ \frac{\text{mm}}{\text{in}} = 3.832\ \text{mm}$$

$$128(\text{pixels}) \times \frac{1}{424.26\ (\text{spi})} = .3017\ \text{in} \times 25.4\ \frac{\text{mm}}{\text{in}} = 7.663\ \text{mm}$$

The technologies that create linear arrays of LED's, composed of discrete chips placed side-by-side, have evolved to where 600 SPI densities are easily achievable. In fact, this density is found in most printers using LED bars. Higher densities are also possible, and a 1200 SPI bar is on the market.

Evaluation of a 1200 SPI bar revealed an inconsistent pitch. The distance between adjacent pixels on different chips was large by more than 4.3 μm or 20% of the pitch. (see FIG. 1) This much error causes undesirable banding on prints. Clearly, the technology that creates LED's has improved to where 1200 SPI LED's are possible, but the technology that places the chips has remained at 600 SPI.

Five design rules govern the creation of true 1200 SPI arrays. State-of-the-art arrays, represented by the evaluated bar, fail to meet all five. The rules are: (1) Emitters can not be too large. Large emitters have optical and electrical crosstalk. (2) Emitters can not be too small. Small emitters inefficiently generate light so require high current and produce high temperatures. (3) Emitters cannot be too close to the chip edge. Close emitters develop an infant mortality caused by fractures created when the chip is diced from the wafer. (4) The gap between chips can not be too small. Small gaps give a high probability that a chip will contact its neighbor and fracture during placement into the array. Furthermore, the gap allows thermal expansion. If chips contact during expansion, they fracture or break the adhesive. (5) The pitch must be consistent or else banding occurs.

Using existing practices, rules (1) and (2) are met as evidenced by the chips of the evaluated bar and by other experimental chips. Chips can be made of viable 10.5 μm width LED's. Rules (3), (4), and (5) remain problematic though. They are mutually exclusive. Chips can be diced no closer than 5 μm from the emitter. Placement is no better than ±1 μm for engineering work and closer to ±2.5 μm for production work. So, 1200 SPI chips can be placed on-pitch as shown in FIG. 2 or over-pitch as shown in FIG. 3. On-pitch yields a gap of 0.7 μm. This exceeds even engineering accuracies so is impractical. The smallest over-pitch yields a spacing of 25.5 μm which is 4.3 μm greater than the ideal pitch of 21.2 μm. The evaluated bar uses it, but of course, with the defect.

Thus, it would be helpful to be able to form a 1200 SPI LED array with a consistent pitch while minimizing the array size and distance between adjacent chips.

SUMMARY OF THE INVENTION

The present invention is directed to a method of forming a high resolution LED array. In one embodiment the method comprises providing a plurality of LED chips to form the LED array. An electrode of an LED located at each end of each chip is inward biased by a predetermined amount. The size of each LED chip is reduced by removing, at each end of each chip, an amount of chip material substantially equal to the predetermined amount. The array is formed by placing each chip end to end with a gap between each chip, wherein the gap is suitably large for placement accuracies in a consistent pitch of approximately 21.2 μm is maintained between each LED on each chip.

In another aspect, the present invention is directed to a high resolution LED printbar. In one embodiment the high resolution LED printbar comprises a plurality of LED chips butted together with a gap between adjacent LEDs to form an array. Each LED chip generally comprises a plurality of LEDs where each LED is adapted to generate an emitted light. A center electrode extends from each LED and is adapted to electrically connect the LED to a wired bond pad. The center electrode is generally positioned over an emitting side of the LED and a centroid of light from each LED is centered over the LED. An LED at each end of the chip has an electrode that is inward biased over each respective end LED. A centroid of emitted light from each end LED is positioned closer to an outer edge of the chip.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT(S)

Figure 6:
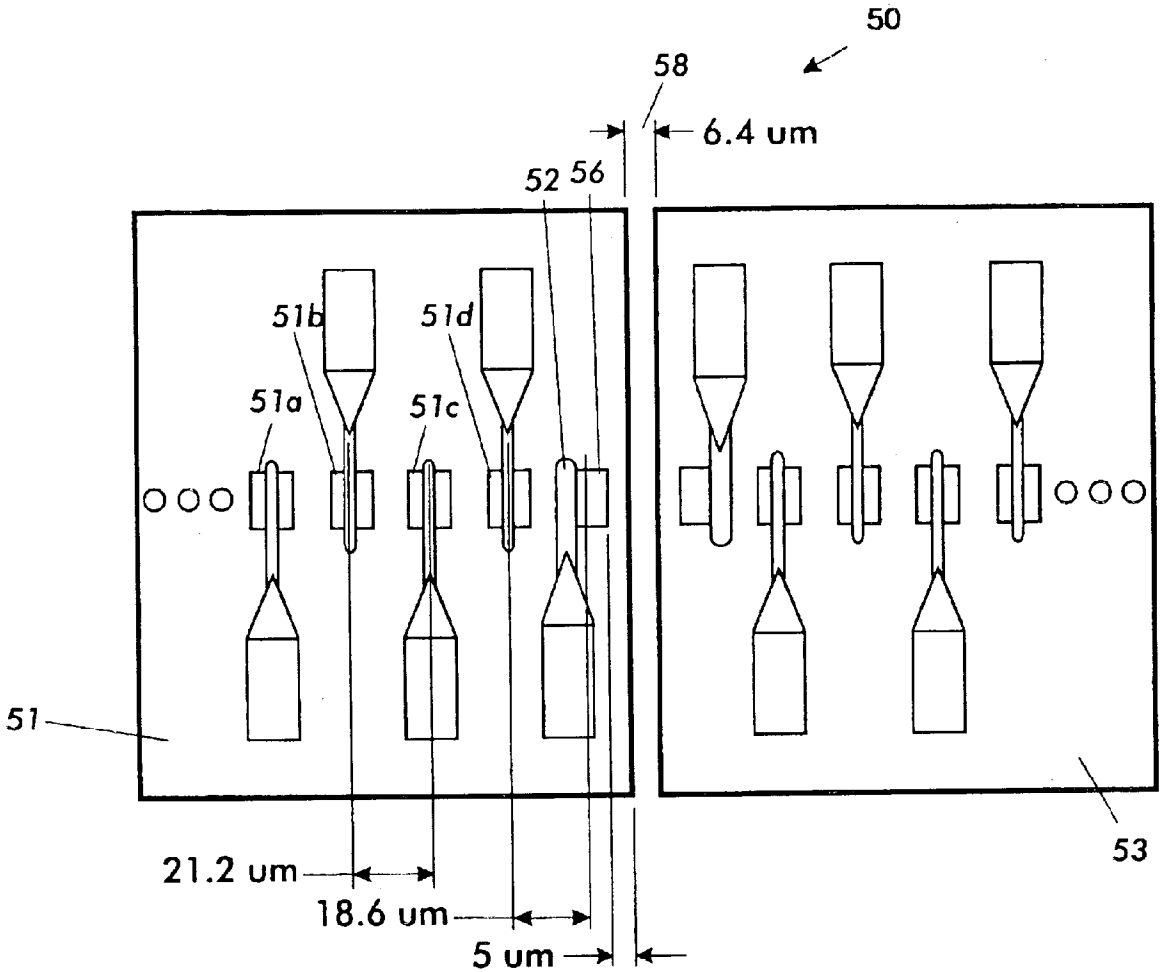
FIG. 6 is an illustration of one embodiment of a 1200 SPI LED chip architecture incorporating features of the present invention.

Referring to FIG. 6, there is shown top a plan view of an LED architecture 50 incorporating features of the present invention. Although the present invention will be described with reference to the embodiment shown in the drawings, it should be understood that the present invention can be embodied in many alternate forms of embodiments. In addition, any suitable size, shape or type of elements or materials could be used.

Figure 2:
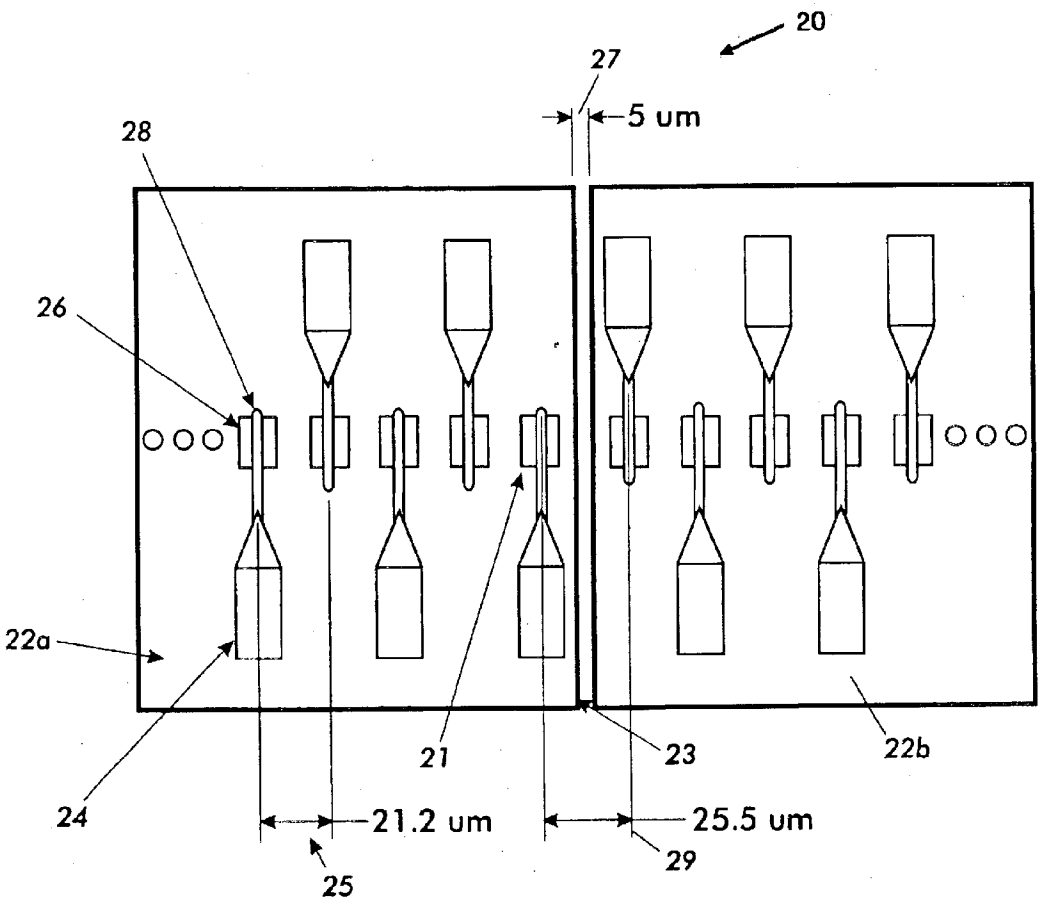
FIG.2 (PRIOR ART)
FIG. 2 is an illustration of 600 SPI architecture applied to a 1200 SPI LED array bar.

A linear LED array generally comprises a series of LED chips. For example, referring to FIG. 2, the LED array 20 comprises at least two LED chips 22. Each LED chip 22 generally comprises a plurality of LED's 26. Each LED 26 is affixed to the LED chip 22 in a conventional fashion. As shown in FIG. 2, each LED 26 has an associated center electrode 28 that can be used to electrically connect the LED 26 to a wire bond pad 24 for example. The center electrode shown in FIG. 2 produces an emission centroid centered over the LED 26. The electrode 28 blocks light at the center but does not change the centroid of the light.

Figure 1:
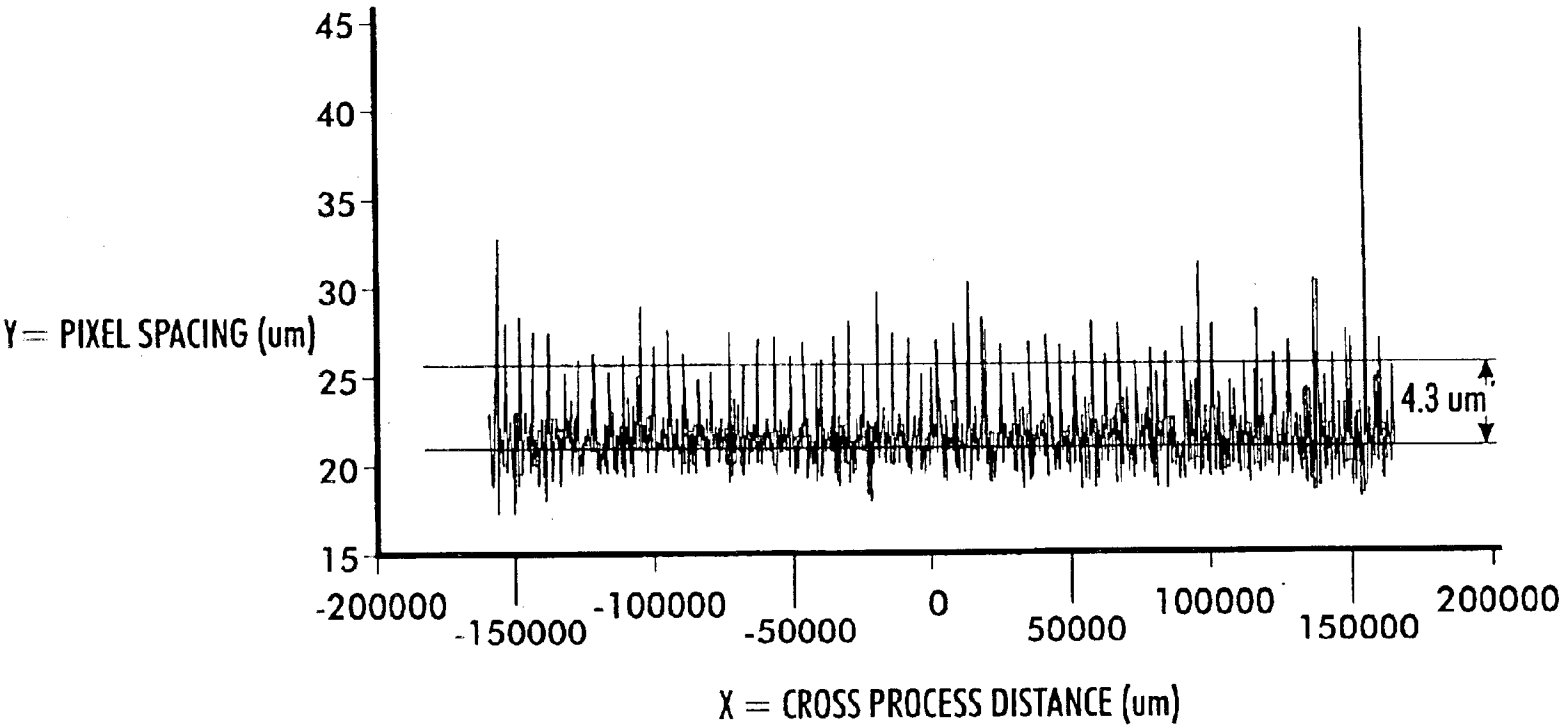
FIG. 1 (PRIOR ART)
FIG. 1 is a graph illustrating the differences in pitch between pixel spacing in a conventional 1200 SPI LED bar.

FIG. 2 is an illustration of a typical 600 SPI architecture applied to 1200 SPI. In order to maintain at least a 5 $\mu$m buffer zone between the end LED 21 and the chip edge 23, as well as maintain at least a 5 $\mu$m gap 27 between chips 22*a*, 22*b*, the pitch 29 between adjacent pixels on different chips is significantly larger than the average pitch 25. This is undesirable. The LED bar evaluated to produce the graph of FIG. 1 is similar to the architecture shown in FIG. 2. FIG. 1 is a graph of the differences in pixel spacing of a 1200 SPI LED bar manufactured by Okidata. The average spacing on pitch between pixels on the same chip is 21.2 $\mu$m. However, the spacing of adjacent pixels on different chips is 4.3 $\mu$m over-pitch. The spikes (could also use "peaks") shown on the graph occur at every chip boundary.

Figure 3:
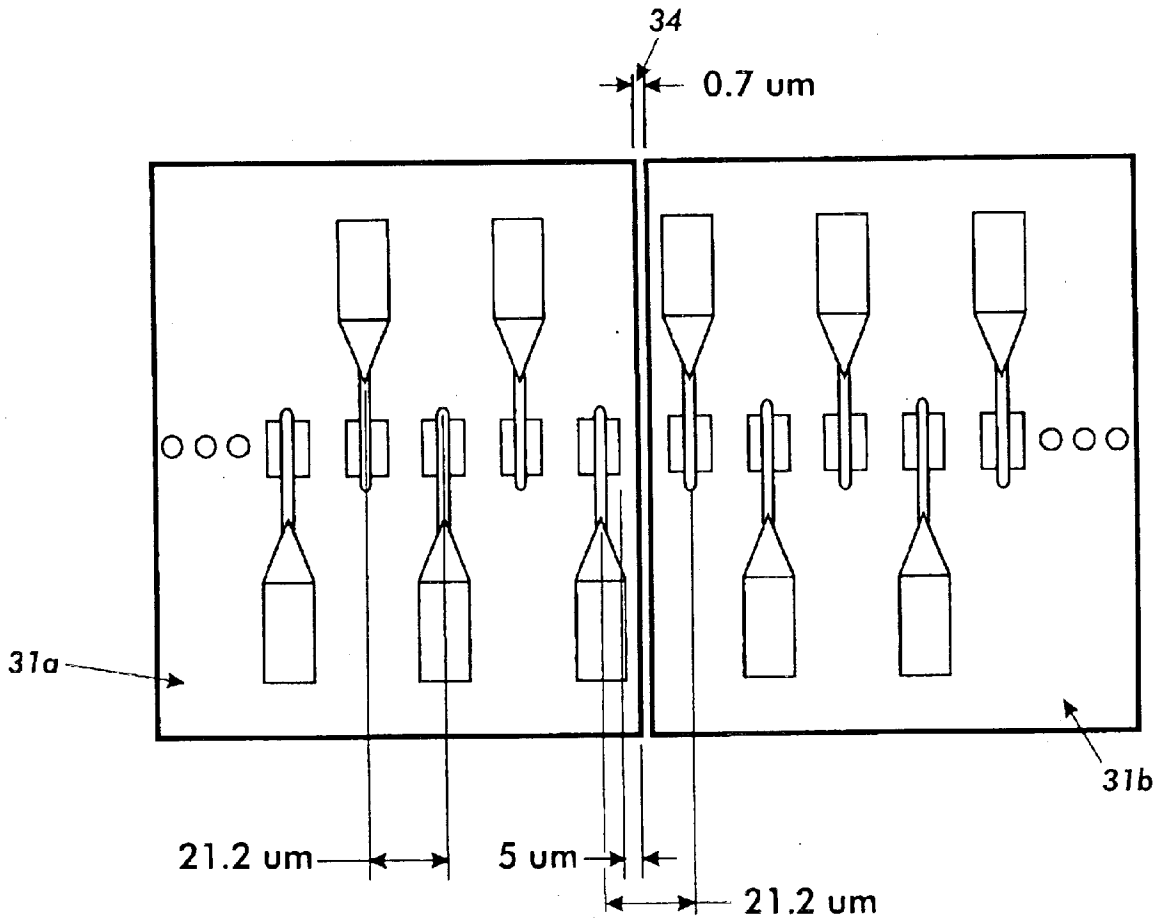
FIG. 3 is an illustration of 1200 SPI LED chips moved closer together to eliminate pitch error.

In order to reduce the pitch error, the LED chips can be moved closer together as shown in FIG. 3. However, in order to eliminate the pitch error, as illustrated in FIG. 2, the chips 22*a* and 22*b* would have to be spaced apart or have a gap 34 of 0.7 $\mu$m. This is not realistic given the capabilities of existing chip placement machines. Additionally, such close placement would result in adjacent chip collisions and fracture. In addition, such a small gap does not provide room for thermal expansion of the chips.

As LED size decreases, structures composing the LED, such as the LED chips 22 shown in FIG. 2 for example, increasingly affect the emitted light profile. For example the top electrode 28 shown in FIG. 2 becomes a factor because its size does not scale proportionately. Gold deposition and current capacity constraints limit the size of the electrode. The electrode over a 1200 SPI LED covers a greater percentage of the LED emitter area, absorbs a greater percentage of the light and affects the emitted light profile more.

Figure 4:
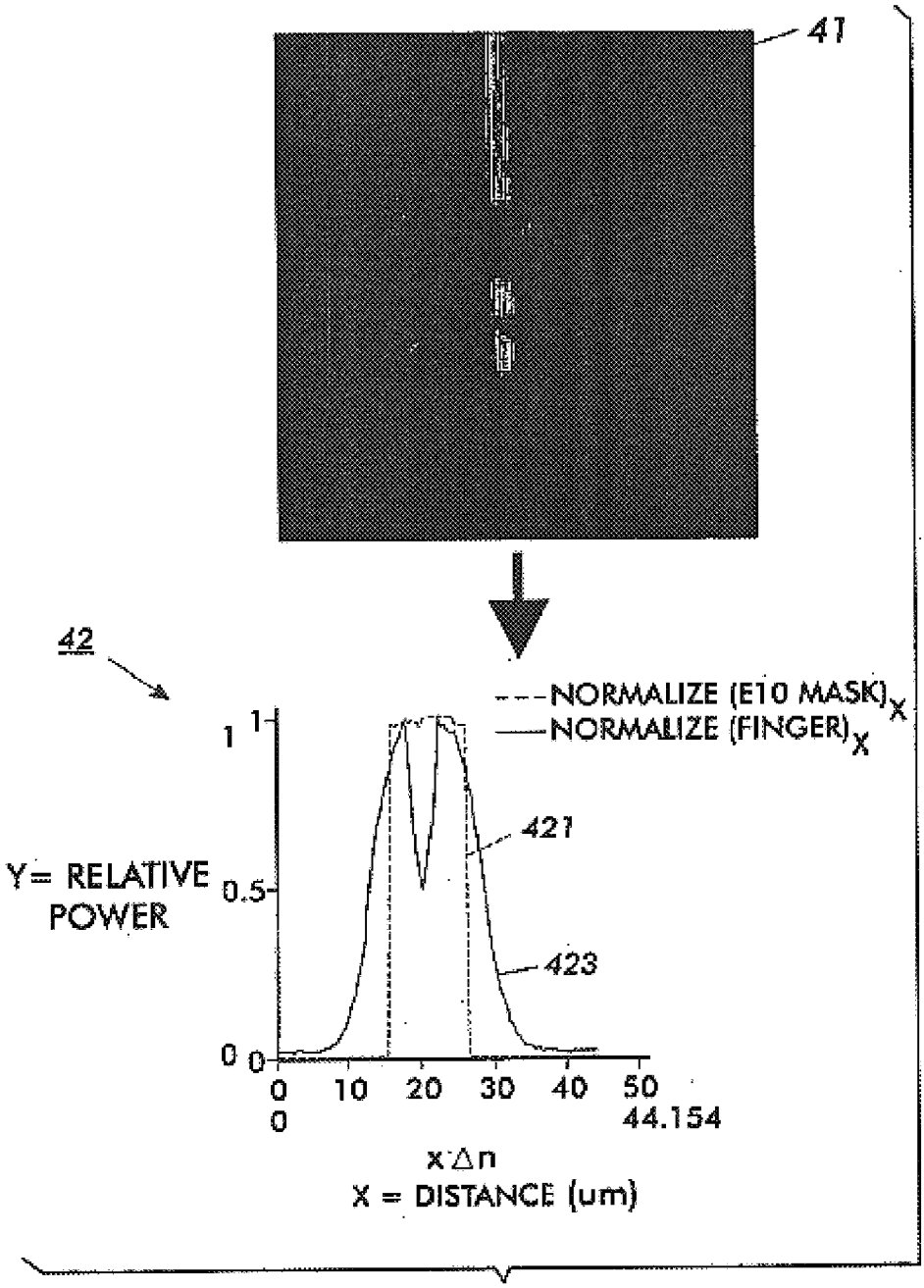
FIG. 4 is a graph comparing the emission performance of a center electrode.

The present invention is used to vary the emitted light profile of an LED. If the electrode 28 is moved toward a side of the emitter, as shown in FIG. 6, the side electrode 52 blocks light at its side so it pushes the centroid toward the opposite side from the position of the side electrode 52. FIG. 4 shows 1200 SPI-sized LEDs with two electrode configurations.

Figure 5:
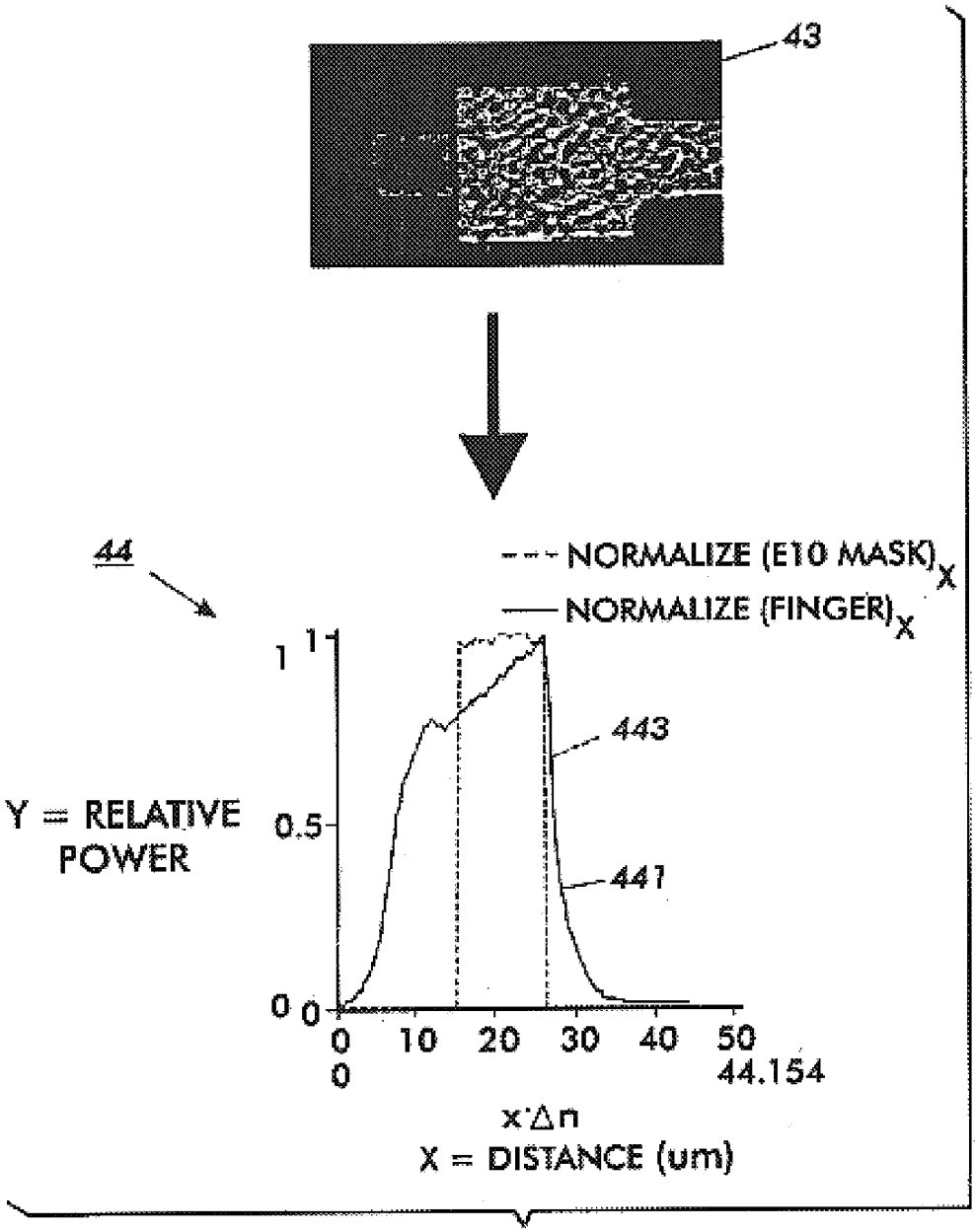
FIG. 5 is a graph comparing the emission performance of a side electrode.

Plots 41 and 43 of FIGS. 4 and 5 are micrographs of 1200 SPI-sized LEDs. The bottom plots 42 and 43 are corresponding near field emission scans overlaid on the LED region. In plot 42 the emission line is 423 and the LED profile line is 421. In plot 44, the emission line is 441 and the LED profile line is 443. The side electrode 52 of FIG. 6 produces a centroid right of center (pushes light toward edge of chip). As shown in FIGS. 4 and 5, the LED profile centroid of each plot 42, 44 is at 20.8 $\mu$m. The emission centroid produced by the center electrode LED 26 of FIG. 2 is at 20.8 $\mu$m. The emission centroid produced by the side electrode LED 56 of FIG. 6 is at 18.2 $\mu$m. The side electrode 52 of FIG. 6 moves the centroid 2.6 $\mu$m relative to the LED 56.

The present invention applies a side electrode configuration to minimize the gap 58 between adjacent LED chips 51 while maintaining a constant pitch between pixels. For example, as shown in FIG. 6, the side electrode 52 biases the centroid towards the edge by approximately 2.6 $\mu$m. The emitter 56 is placed inwards by the same amount to maintain the correct spacing with other pixels 51*a*–51*d* on the chip 51. Moving or shifting the emitter 56 inwards allows the chip 51 to be smaller by the same amount. This is done to both sides of each chip in the array. The gap 58 between adjacent arrays is widened by approximately twice the amount that the emitter 56 is shifted, or as shown in FIG. 6, 5.2 $\mu$m. As shown in FIG. 6, a gap 58 of approximately 6.4 $\mu$m can be established between adjacent chips 51 and 53, which is suitably large for chip placement accuracies and thermal expansion. The configuration shown in FIG. 6 also complies with the other form design rules for 1200 SPI arrays, and achieves a true 1200 SPI array with a consistent pitch of approximately 21.2 $\mu$m. Although the disclosed embodiments are described herein with reference to a 1200 SPI array, the features of the disclosed embodiments can be applied to any high resolution imager or scanner made by butting IC's to form an array.

In alternate embodiments, the electrode configuration shown in FIG. 6 can require tuning for different LED material sets and wavelengths because the side electrode profile 44 shown in FIG. 4 implies that light transmission through a material could also be a factor. The power of the asymmetrical pixel could also be adjusted so that its width is comparable to others.

By shifting the electrode of an LED to the side of the emitter, the light centroid is pushed toward the opposite side. This shift in light intensity can make the end LED devices on each chip of a printhead in an array appear closer to the end than they actually are. This allows the chips to be smaller and the gap between chips to be widened, while maintaining a constant pitch of for example, 21.2 $\mu$m between the pixels of the chips in the array. The resulting gap overcomes the problems associated with a smaller gap, such as chips colliding, arm fracture, or chip placement errors. The present invention provides 1200 SPI and greater linear arrays with substantially no pitch errors at chip junctions and better image quality characteristics.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method of forming a high resolution LED array comprising the steps of:

providing a plurality of LED chips to form the LED array;

inward biasing an electrode of an LED located at each end of each chip by a predetermined amount;

reducing a size of each LED chip by removing, at each end of each chip, an amount of chip material substantially equal to the predetermined amount; and forming the array by placing each chip end to end with a gap between each chip, wherein the gap is suitably large for placement accuracies and a consistent pitch of approximately 21.2 μm is maintained between each LED on each chip.

2. The method of claim 1 wherein the step of inward biasing the electrode comprises positioning the electrode approximately 2.6 μm from the edge.

3. The method of claim 1 wherein the predetermined amount is approximately 2.6 μm.

4. The method of claim 1 wherein the step of inward biasing includes shifting a centroid of light emitted from the LED to a side of the chip near the end of the chip, wherein an emitted light profile of the LED is varied to allow the gap between adjacent chips to be larger while a consistent distance is maintained between adjacent pixels on each chip.

5. The method of claim 1 wherein the step of inward biasing includes biasing a centroid of each LED at the end of each chip toward the edge.

6. The method of claim 1 wherein the high resolution LED array formed comprises an LED array providing at least 1200 spots per inch ("SPI").

* * * * *